US007719470B2

(12) United States Patent
Wang et al.

(10) Patent No.: US 7,719,470 B2
(45) Date of Patent: May 18, 2010

(54) MULTI-BAND ANTENNA, AND ASSOCIATED METHODOLOGY, FOR A RADIO COMMUNICATION DEVICE

(75) Inventors: Dong Wang, Waterloo (CA); Geyi Wen, Waterloo (CA); Qinjiang Rao, Waterloo (CA); Mark Pecen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 320 days.

(21) Appl. No.: 11/843,802

(22) Filed: Aug. 23, 2007

(65) Prior Publication Data

US 2009/0051595 A1 Feb. 26, 2009

(51) Int. Cl.
*H01Q 9/04* (2006.01)
*H01Q 1/38* (2006.01)

(52) U.S. Cl. ..... 343/700 MS; 343/702; 343/767; 343/846

(58) Field of Classification Search ..... 343/700 MS, 343/702, 722, 767, 846, 895
See application file for complete search history.

(56) References Cited

U.S. PATENT DOCUMENTS 6,734,825 B1 * 5/2004 Guo et al. ..... 343/700 MS
6,933,893 B2 * 8/2005 Rubinshteyn et al. . 343/700 MS
6,982,675 B2 * 1/2006 Kwak et al. ..... 343/702
7,079,079 B2 * 7/2006 Jo et al. ..... 343/700 MS
2002/0075190 A1 6/2002 Ghosh et al.
2003/0142022 A1 7/2003 Ollikainen et al.
2007/0001906 A1 * 1/2007 Pelzer et al. ..... 343/700 MS

FOREIGN PATENT DOCUMENTS

WO 0235652 A1 5/2002
WO 2004008573 A1 1/2004

* cited by examiner

*Primary Examiner*—Douglas W Owens
*Assistant Examiner*—Chuc D Tran

(57) ABSTRACT

An antenna, and an associated methodology, for a portable radio device, such as a mobile station capable of operation at a plurality of frequency bands spread across a wide range of frequencies. The antenna includes a first antenna patch and a second antenna patch. The first antenna patch comprises an L-shaped patch disposed upon a substrate. A second antenna patch forms a folded patch formed of three contiguous portions, folded about fold lines in a manner to cause the second antenna patch to include a first contiguous portion that extends upwardly beyond the first antenna patch at an angle perpendicular thereto. Second and third contiguous portions are formed by folding additional portions of the second antenna patch about additional fold lines.

32 Claims, 7 Drawing Sheets

MULTI-BAND ANTENNA, AND ASSOCIATED METHODOLOGY, FOR A RADIO COMMUNICATION DEVICE

The present invention relates generally to a manner by which to transduce signal energy at a radio device, such as a portable mobile station. More particularly, the present invention relates to an antenna, and an associated methodology, for the radio device.

The antenna is of dimensions permitting its positioning within, or carriage together with, a hand-carriable mobile station while providing operability over a wide range of frequencies. The antenna is formed of a set of antenna patches that are configured together in a tri-dimensional arrangement. The spatial requirements of the antenna are reduced by folding one of the patches to cause contiguous portions thereof to extend in planar directions offset from that of another of the antenna patches. The antenna is operable with a multi-mode radio device that operates at multiple, spaced frequency bands.

BACKGROUND OF THE INVENTION

Mobile communications have become pervasive throughout modern society. Ready access to a mobile communication system is, for many, a practical necessity. A cellular, or cellular-like communication system is an exemplary mobile radio communication system whose availability is widespread throughout significant portions of the populated areas of the world.

A cellular communication system is constructed generally to be in conformity with operational requirements set forth in an operating specification promulgated by a standards-setting body. The operating specification, amongst other things, defines a radio air interface extending between communication stations, i.e., the network infrastructure and a mobile station, operable in the communication system. Regulatory bodies allocate portions of the electromagnetic spectrum. Different allocations are made for different types of systems, and different regulatory bodies regulate the use of the electromagnetic spectrum in different jurisdictions. And, operating standards associated with different communication systems define operating parameters including parameters associated with the frequencies upon which the radio air interface is defined.

While early implementations of mobile stations used to communicate in a cellular communication system were relatively bulky, and were relatively heavy, advancements in integrated-circuit, processing, and communication technologies have permitted the miniaturization of newer implementations of mobile stations. Mobile stations are now regularly of dimensions permitting their hand-carriage. And, increasingly, mobile stations are constructed to be operable in conformity with the operating requirements of more than one operating standard. Such a mobile station, referred to as a multi-mode mobile station, is capable of operation pursuant to a communication service by way of any communication system with which the multi-mode mobile station is operable.

Miniaturization of a mobile station provided as a result of the technological advancements noted-above has permitted the circuitry required for multi-mode mobile station to be housed in a housing of small dimension. Multi-mode mobile stations are, for example, sometimes of configurations permitting their carriage in a shirt pocket of the user. Miniaturization is provided, not only by reducing the physical dimensions of the circuit paths of the receive and transmit chains of the circuitry of the mobile station, but also through sharing of circuit components between circuit paths used for communications pursuant to the different communication systems.

Miniaturization of antenna elements presents unique challenges, particularly when the antenna element is to form part of a multi-mode mobile station, operable at disparate frequency bands. An antenna element is generally most effective in transducing signal energy when the transducer is of dimensions related to the wavelength of the signal energy that is to be transduced. For instance, antenna lengths corresponding to, or multiples of, one-quarter wavelengths of the signal energy that is to be transduced exhibit good antenna characteristics. When the mobile station forms a multi-mode mobile station that operates at different frequency bands, different sizes of antennas are needed to transduce the signal energy of the different frequencies and wavelengths. As the sizes of housings otherwise required to house the circuitry of a multi-mode mobile station continue to decrease, dimensional requirements of the antenna elements are sometimes a limiting factor limiting further miniaturization of a mobile station. Significant effort has therefore been exerted to construct an antenna, operable over multiple frequency bands, that is also of small dimension, thereby to permit its positioning within the housing of a mobile station.

A PIFA (Planar Inverted-F Antenna) is sometimes utilized to transduce signal energy at a mobile station. Generally, a PIFA is of compact size and is of a low profile while providing for transducing of signal energy at more than one frequency band. A problem typically exhibited with a PIFA, however, is that a PIFA generally exhibits pass bands of narrow bandwidths. A bandwidth of a PIFA is enhanced by configuring the PIFA together with a parasitic element. Such use of a parasitic element, however, increases the dimensions of the antenna. Additionally, tuning of the antenna becomes more difficult due to the additional resonant branches. Also, the branches sometimes introduce EMI (Electromagnetic Interference) that interferes with antenna operation.

An improved antenna structure, of small dimensions, and operable to transduce signal energy at multiple, disparate frequency bands is therefore needed.

It is in light of this background information related to radio communications that the significant improvements of the present invention have evolved.

DETAILED DESCRIPTION

Figure 1:
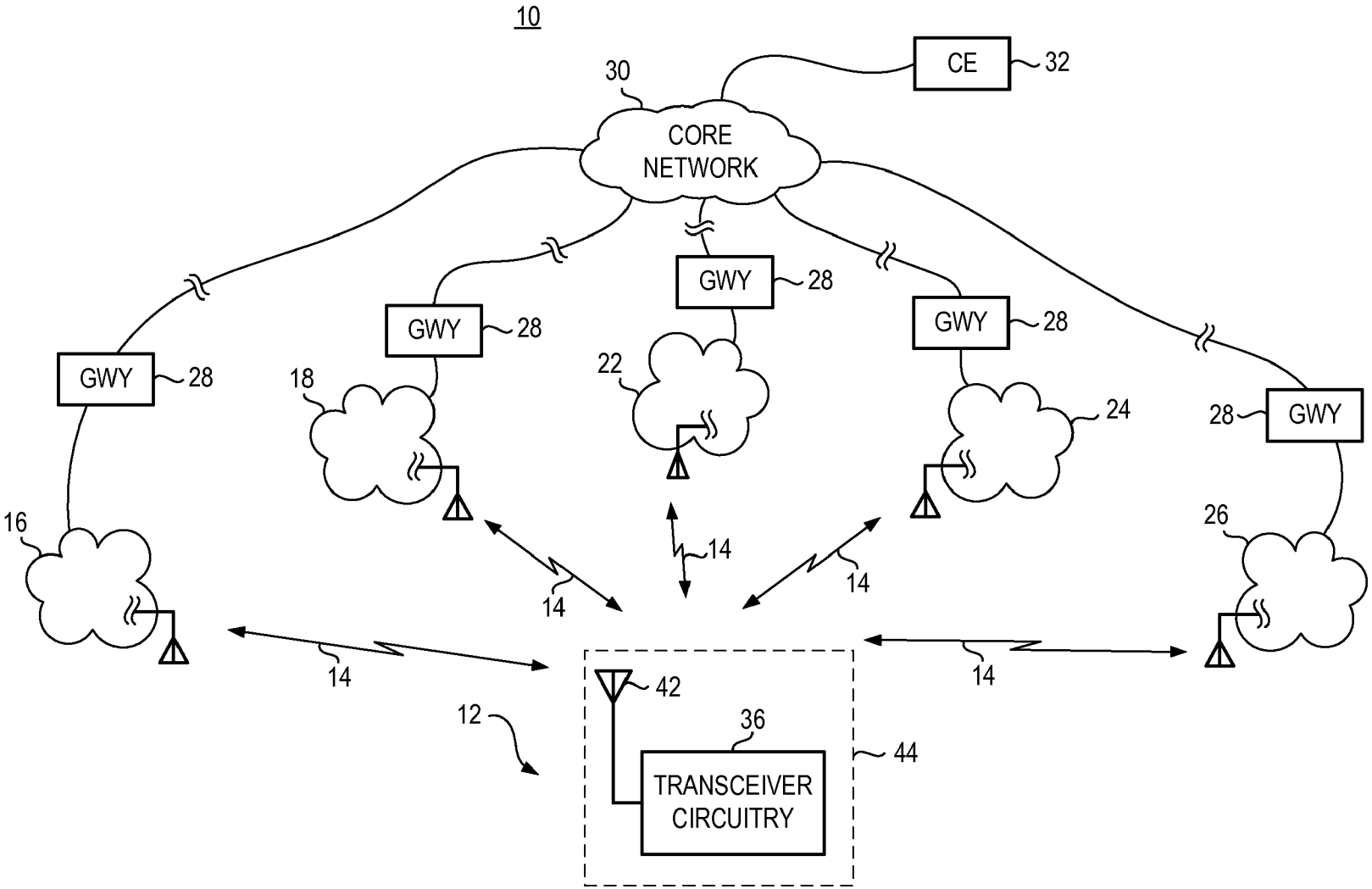
FIG. 1 illustrates a functional block diagram of a radio communication system in which an embodiment of the present invention is operable.

The present invention, accordingly, advantageously provides an antenna, and an associated methodology for transducing signal energy at a radio device, such as a portable mobile station.

Through operation of an embodiment of the present invention, an antenna is provided for the radio device. The antenna is of compact dimensions that permits its positioning within, or carriage together with, a mobile station. The antenna characteristics of the antenna permit its operation at selected frequency bands over a wide range of frequencies.

The antenna includes a set of antenna patches that are configured together in a tri-dimensional arrangement that extends in multiple planar directions. Reduction in the spatial requirements of the antenna is provided by the tri-dimensional configuration of the antenna. One of the patches of the set of antenna patches is forwarded such that contiguous portions thereof extend in planar directions offset from that of a portion contiguous thereto. The antenna is configured to be operable at disparate frequency bands over a wide range of frequencies.

In another aspect of the present invention, a first patch of the antenna forms a first main radiation element. The first patch is L-shaped, forming an L-shaped patch. The first radiation element is resonant at a frequency band depending upon the length of the patch and its location of connection to the second patch of the antenna. The first main radiation element forming the L-shaped patch includes both a feed point connection and a ground connection that are connectable with corresponding portions of the circuitry of the mobile station. Signal energy generated at the mobile station circuitry is provided to the antenna at the feed point connection, and signal energy transduced into electrical form at the antenna is provided to the transceiver circuitry at the feed point connection. The L-shaped patch includes a lengthwise-extending leg piece and a foot piece extending outwardly therefrom. Appropriate selection of the dimensions of the leg piece and of the foot piece are determinative, together with the location of the connection of the L-shaped patch with the second antenna patch, of the characteristics of the first antenna patch.

In another aspect of the present invention, the second antenna patch forms a folded patch, formed of multiple folded portions. A first portion is contiguous to, and integral with, the L-shaped patch forming the first antenna patch. The first portion is folded to extend in a planar direction offset from that of the planar direction in which the L-shaped first antenna patch extends. The first folded portion of the folded antenna patch extends, e.g., in a planar direction substantially perpendicular to the planar direction in which the L-shaped, first antenna patch extends. The folded antenna patch further includes a second folded portion, formed contiguous to, and integral with, the first folded portion. The second folded portion is folded to extend in a direction offset from the planar direction in which the first folded section extends. The second folded portion extends in a direction, e.g., substantially perpendicular to the planar direction in which the first folded portion extends. And, the folded antenna patch further includes a third folded portion, formed contiguous to and integral with the second folded portion. The third folded portion extends, e.g., in a direction substantially perpendicular to the planar direction in which the second folded portion extends. Thereby, the spatial requirements of the second antenna patch are reduced relative to the space that the second antenna patch would be required to be provided if the antenna were not folded.

In another aspect of the present invention, the folded, second antenna patch includes a tuning strip, tunable to be of a length to cause the antenna patch to include resonant frequencies at a desired frequency range.

In one implementation, the antenna forms a pent-band antenna, capable of operation at five disparate frequency bands, including the 850, 900, 1800, 1900, and 2200 MHz frequency bands. In other implementations, the antenna is configured to be resonant at other, and other numbers of, frequency bands. When connected to transceiver circuitry capable of operating in conformity with communication systems at the corresponding frequencies, the antenna permits signal energy to be transduced at any of the resonant frequencies. Due to its compact size, the antenna facilitates increased miniaturization of a mobile station, permitting its positioning within the housing of the mobile station.

In these and other aspects, therefore, an antenna, and an associated methodology is provided for a radio communication device. A first patch forms a first radiation element. The first patch is defined in a first planar direction and is resonant at least at a first higher frequency band. A second patch forms a second resonant element. The second patch includes a contiguous first portion, contiguous and integral with, the first patch. The contiguous first portion is folded to be upstanding beyond the first planar direction in which the first patch extends. Thereby, the contiguous first portion extends in a second planar direction. The second patch is resonant at a lower frequency band and a second higher frequency band. The first and second higher frequency bands are, e g., of corresponding, overlapping, or differing frequencies.

Referring first, therefore, to FIG. 1, a radio communication system, shown generally at 10, provides for communication services, with mobile stations, of which the mobile station 12 is representative, by way of radio links defined upon a radio air interface 14. While the mobile station is generally representative of a mobile station operable in conformity with operating protocols of any of various operating specifications, in the exemplary implementation, the mobile station is operable to communicate at the 850, 900, 1800, 1900, and 2200 MHz frequency bands that correspond to 4 GSM (Global System for Mobile communications) frequency bands and a UMTS (Universal Mobile Telephone Service) band. Operability of the mobile station at the GSM frequencies and the UMTS frequencies provides a mobile station that is permitting of operation in a majority of the world-wide areas that provide for cellular-type communications.

A plurality of radio access networks (RANs), radio access networks 16, 18, 22, 24, and 26 are illustrated in FIG. 1. The radio access networks 16-26 are representative, respectively, of a GSM 850 MHz system, a GSM 900 MHz system, a GSM 1800 MHz system, a GSM 1900 MHz system, and a UMTS 2200 MHz network, respectively. When the mobile station 12 is positioned within the coverage area of any of such networks 16-26, the mobile station is capable of communicating with the radio access network. Here, merely for purposes of simplicity, the mobile station is positioned within the coverage of each of the radio access networks. That is to say, in the illustrated example, all of the networks have overlapping coverage areas. In an actual implementation, various of the networks are implemented in separate, and non-overlapping, jurisdictional areas. The radio access networks 16-26 are coupled, here by way of gateways (GWYs) 28 to a core network 30. A communication endpoint (CE) 32 is coupled to the core network. The communication endpoint is representative of a communication device that communicates with the mobile station.

The mobile station sends data upon the radio air interface 14 and receives data communicated thereon. Transceiver circuitry 36 is embodied at the mobile station, formed of a transmit part and a receive part to operate upon data that is to be communicated by the mobile station or data that is received thereat. The receive and transmit chains forming the receive and transmit parts, respectively, of the transceiver circuitry are operable in conformity with the operating standards and protocols associated with, and defining, the respective systems. The transceiver circuitry of the mobile station is coupled to an antenna 42 of an embodiment of the present invention. The antenna is constructed to permit its operation to transduce signal energy at all of the frequency bands at which the mobile station transceiver circuitry is operable. That is to say, in the exemplary implementation, the antenna 42 operates to transduce signal energy at any of the 850, 900, 1800, 1900, and 2200 MHz frequency bands. In the exemplary implementation, the antenna is positioned within the housing 44 of the mobile station to be supportively enclosed by the housing. Howsoever positioned, the antenna is of small dimensions, facilitating its carriage together with the mobile station at any of the frequencies at which the mobile station operates.

Figure 2:
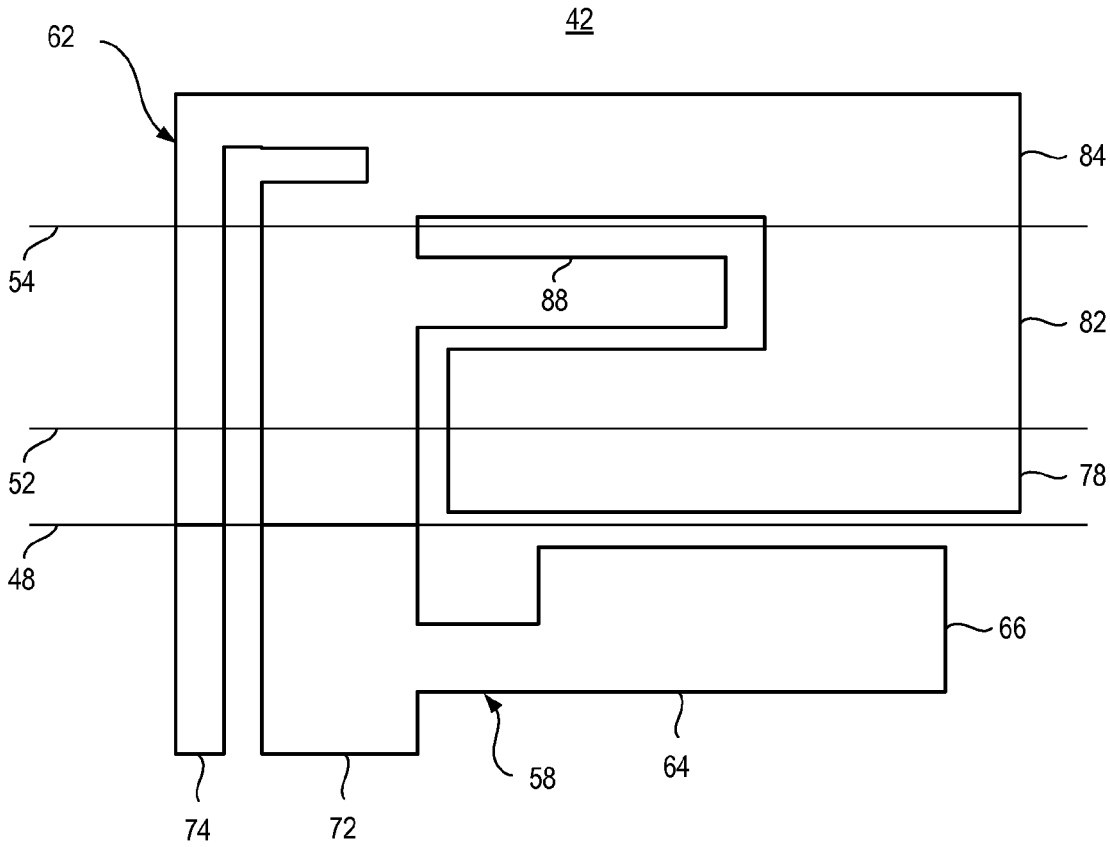
FIG. 2 illustrates a representation of the configuration of the antenna of an embodiment of the present invention.

FIG. 2 illustrates the antenna 42, shown in FIG. 1 to form part of the mobile station 12. The exemplary implementation shown in FIG. 2 forms a pent-band, i.e., a five-band, antenna that operates in conjunction with a five-band mobile station to transduce signal energy during its operation. The view shown in FIG. 2 is representative of the antenna prior to configuration into a tri-dimensional form. The view is that of the pattern of the antenna. And, once formed, the antenna is folded at folds 48, 52, and 54, as shall be described below. By forming the folds in the antenna, the antenna is shaped into three dimensions to be tri-dimensional in shape. As each of the folds taken along the respective folding lines, in the exemplary implementation, forms a substantially perpendicular angle, the resultant form of the antenna is substantially rectangular.

The antenna includes two antenna patches, a first antenna patch 58 and a second antenna patch 62. The first antenna patch 58 here comprises an L-shaped patch including a lengthwise-extending leg part 64 and an outwardly-extending foot part 66. An outer lengthwise dimension of the L-shaped patch extends in a linear direction along the entire length of the patch. An inner lengthwise dimension, also extending in the same linear direction, is of a length that extends to the foot part and is of a length, in part, dependent upon the positioning and configuration of the foot part. The first antenna patch is connected to the transceiver circuitry (shown in FIG. 1) of the mobile station at a feed point connection 72 and a ground connection 74. The first antenna patch is resonant at a frequency band of frequencies determined by the characteristics of the antenna patch. Through appropriate selection of the lengthwise dimension of the patch, i.e., the length of the leg piece of the L-shaped patch together with the location of connection of the second antenna patch is, in significant part, determinative of the operable frequency band of the first antenna patch. In the exemplary, pent-mode embodiment, the first antenna patch is configured to exhibit a resonant band of a relatively high frequency.

The second antenna patch 62 forms a folded patch with three portions, a first portion 78, a second portion 82, and a third portion 84 defined by the folding lines 48, 52, and 54, respectively. That is to say, the portion 78, 82, and 84 are defined by the folding of the antenna patch at the fold lines. The first portion is constructed to be contiguous to, and integral with, portions of the first antenna patch 58. When folded about the fold line 48, the portion 78 extends in a second planar direction, offset from a first planar direction in which the first antenna patch extends. The planar directions are offset, e.g., by ninety degree angles to be perpendicular to one another.

The second portion 82 is formed contiguous to, and integral with, the first portion 78. Folding of the second portion about the fold line 52 causes the second portion to extend in a third planar direction, offset from the second planar direction in which the portion 78 extends. In the exemplary implementation, the angle formed by folding of the antenna patch about the fold line 54 forms a substantially perpendicular angle to cause the third portion to extend in a planar direction substantially perpendicular to the planar direction of the second portion. The three portions of the second antenna patch and the first antenna patch define four planar directions that, when perpendicular, together define a rectangular shape.

The second portion 82 of the antenna patch 62 includes a tuning strip 88 that is of a length that is determinative of one of the frequency ranges, and hence bands, at which the antenna is resonant. And, the length of the patch, in the lengthwise direction, independently determines resonant frequencies at a lower frequency band and at a high frequency band. Tuning of the lower frequency is provided by the selection, or change, of the configuration of the tuning strip.

Figure 3:
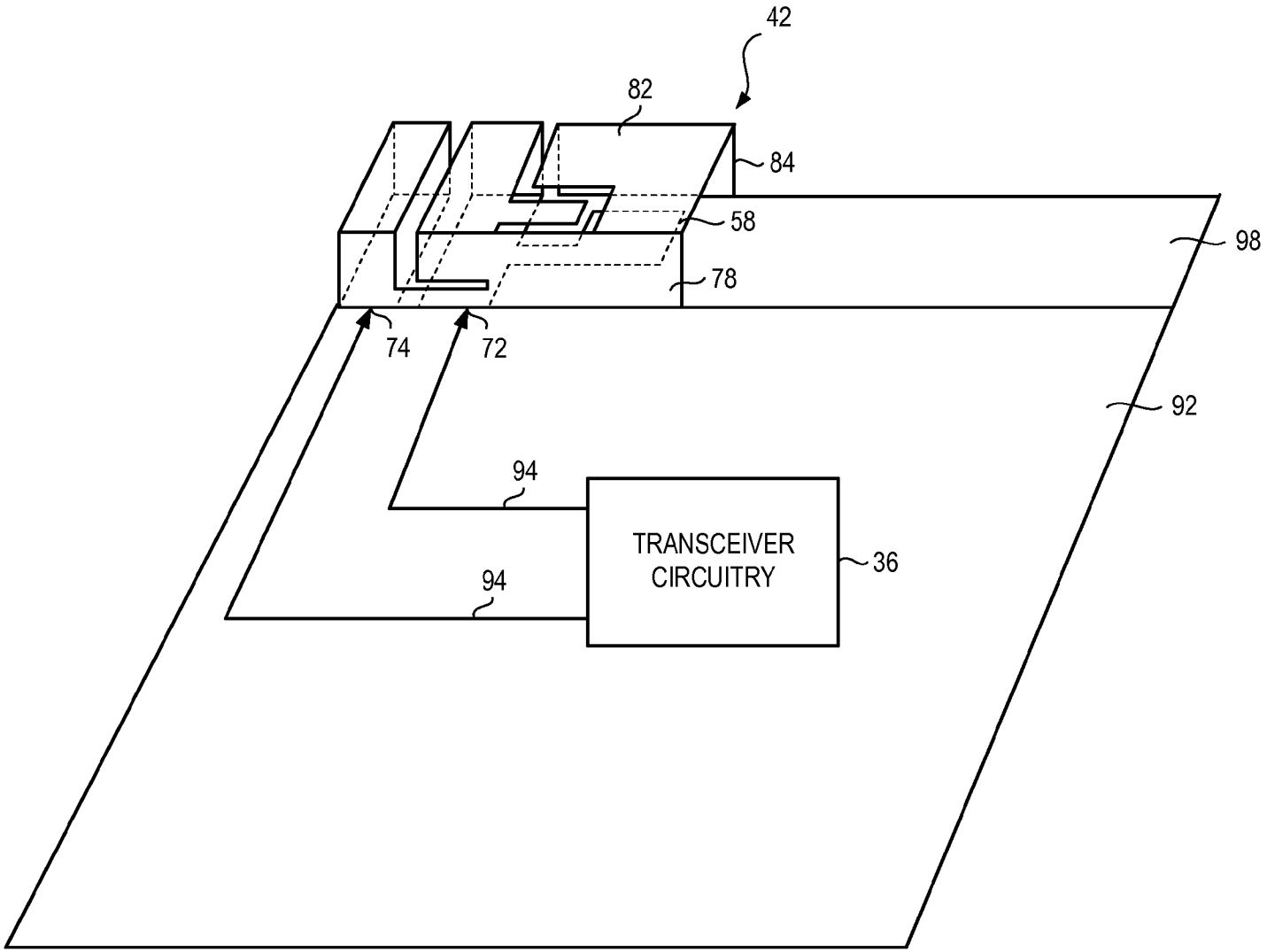
FIG. 3 illustrates a representation of the antenna shown in FIG. 2, here in which the antenna is configured with folds formed in the folded patch portion thereof.

FIG. 3 again illustrates the antenna 42, shown previously in FIGS. 1 and 2. The antenna is here positioned at a substrate 92 at which the transceiver circuitry 36 is mounted. The transceiver circuitry is connected by way of conductive paths 94 with the feed point connection and the ground connection 72 and 74, respectively. The antenna is mounted upon a substrate part 98 that, in the exemplary implementation forms a FR-4 dielectric substrate of a thickness of 1.5 millimeters and is of a relative permittivity of 4.4. Folded as shown, the second portion 82 of the second antenna patch is upstanding beyond the first antenna patch 58. The first portion 78 is of a height of 10 millimeters in the exemplary implementation. And, the ground panel size is 55 millimeters by 90 millimeters. The conductive paths of the first and second antenna patches of the antenna are of lengths and widths that are resonant at selected frequency ranges, selected in the exemplary implementation to be resonant at five frequency ranges, including the 850, 900, 1800, 1900, and 2200 MHz bands. And, a lower frequency band width extends between 824 and 961 MHz while a higher frequency band width extends from 1700 to 2200 MHz. Appropriate selection of the dimensions of the first antenna patch extends the bandwidth of the higher frequency band to extend between 1600 and 2300 MHz. Due to the folded nature of the second antenna patch, the space required on the substrate 92/98 is reduced relative to a two-dimensional implementation.

Figure 4:
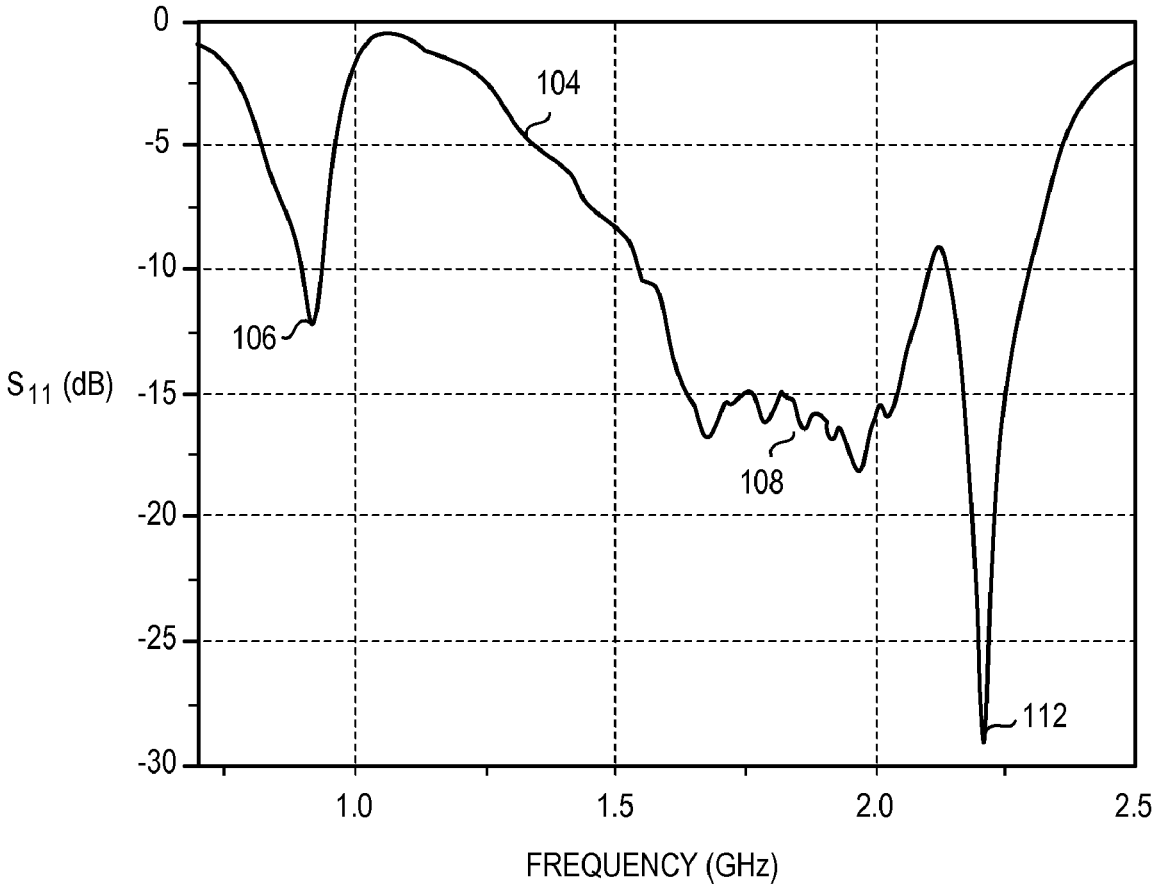
FIG. 4 illustrates a representation of an exemplary return loss, plotted as a function of frequency, of an exemplary antenna of an embodiment of the present invention.

FIG. 4 illustrates a graphical representation 104 that shows exemplary return loss of an exemplary antenna 42 shown in any of the preceding figures. Review of the representation illustrates pass bands 106, 108, and 112. Through appropriate selection of the configuration of the antenna, the pass bands are located at other frequencies.

Figure 5:
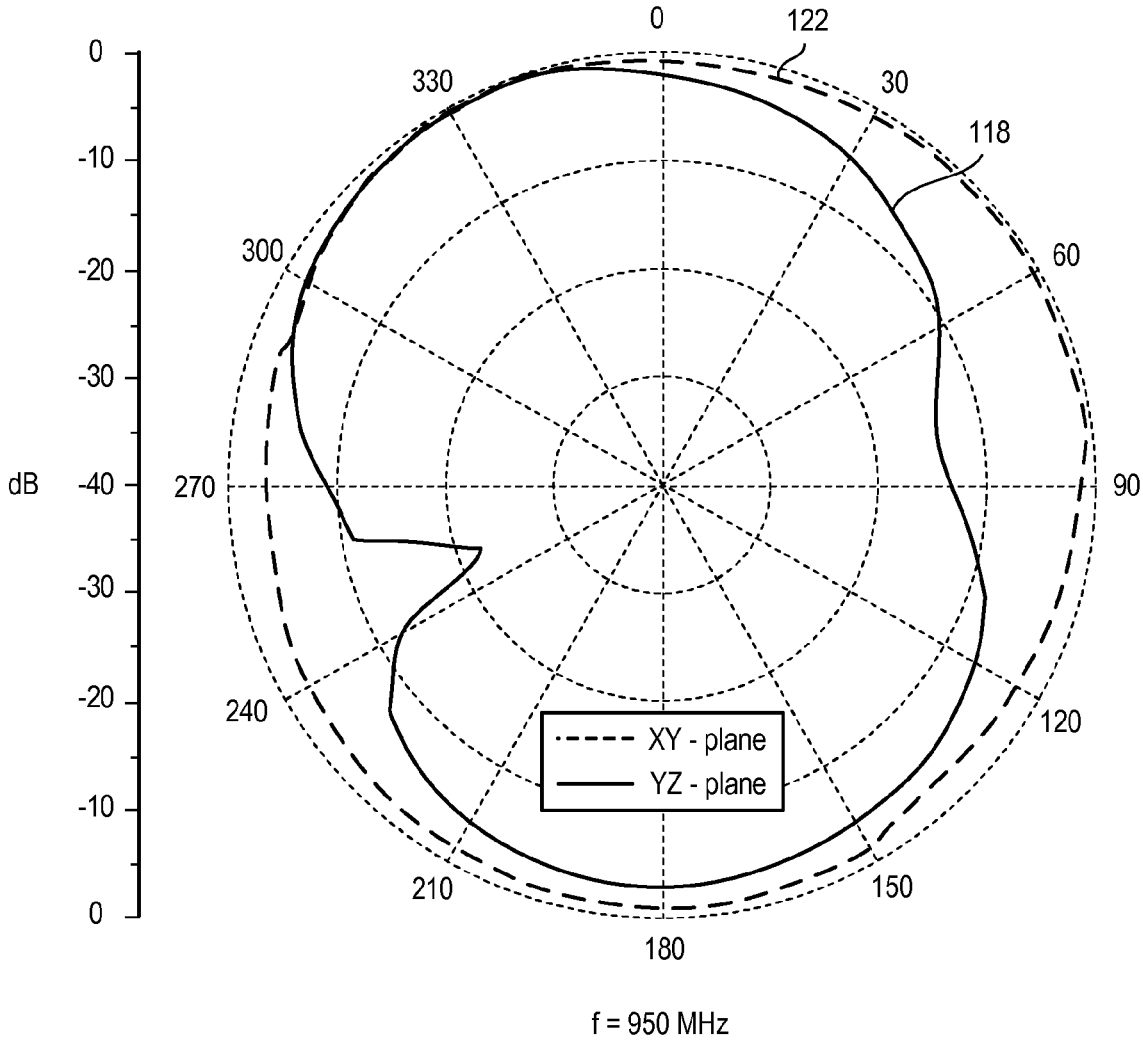
FIGS. 5 and 6 represent exemplary radiation patterns exhibited by the antenna of an embodiment of the present invention at two separate frequencies, at 950 MHz and 1880 MHz, respectively.
Figure 6:
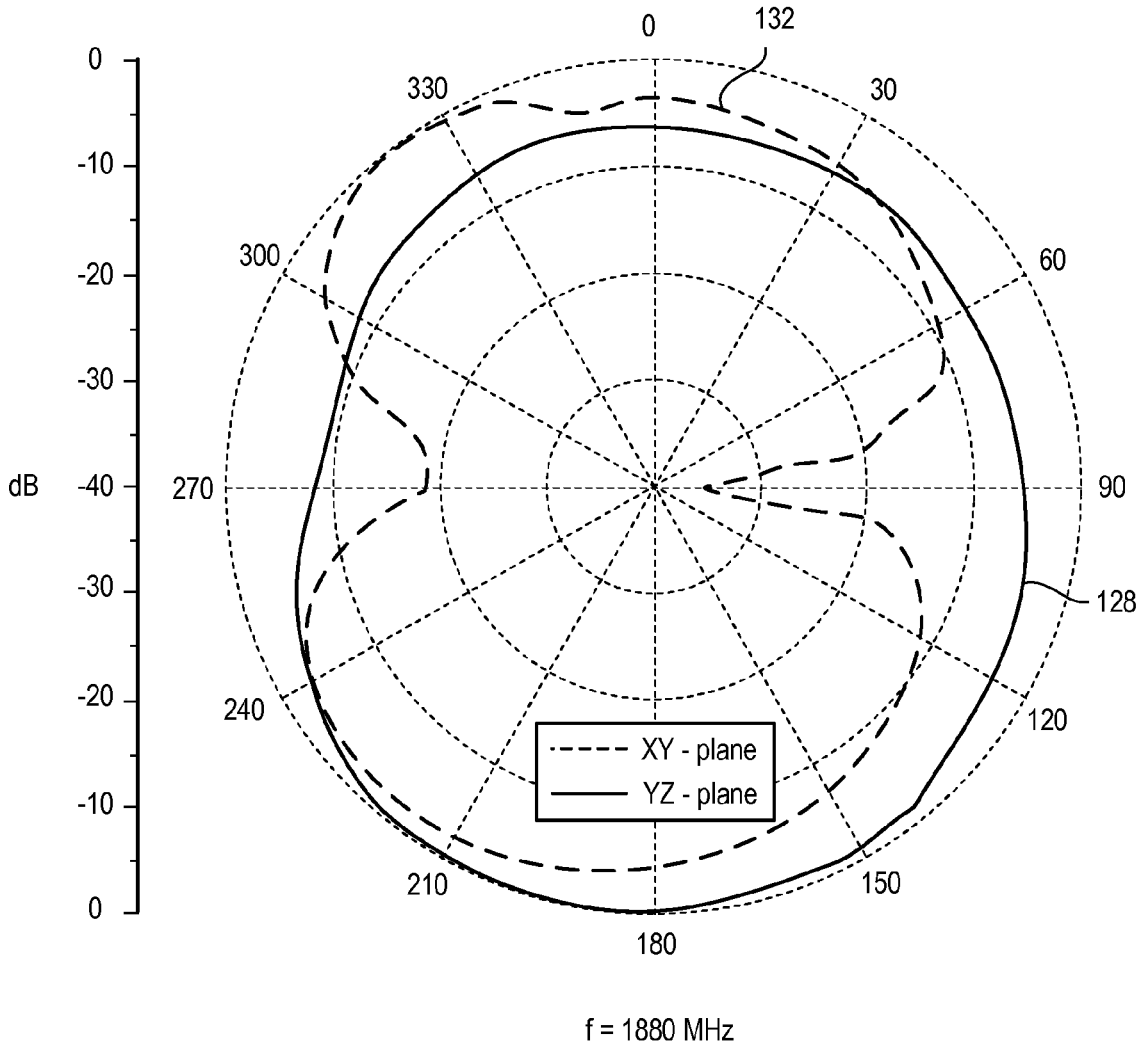

FIGS. 5 and 6 illustrate exemplary radiation patterns exhibited by the antenna 42 in an exemplary implementation. In FIG. 5, a first plot 118 is representative of the radiation pattern at 950 MHz in the YZ plane. And, the curve 122 is representative of a second radiation pattern, also at the 950 MHz frequency, but in an XY plane.

Analogously, in FIG. 6, a first radiation pattern 128 is representative of the radiation pattern at 1880 MHz in the YZ plane. And, the radiation pattern 132 is representative of the radiation pattern, at the same frequency, but in the XY plane.

Figure 7:
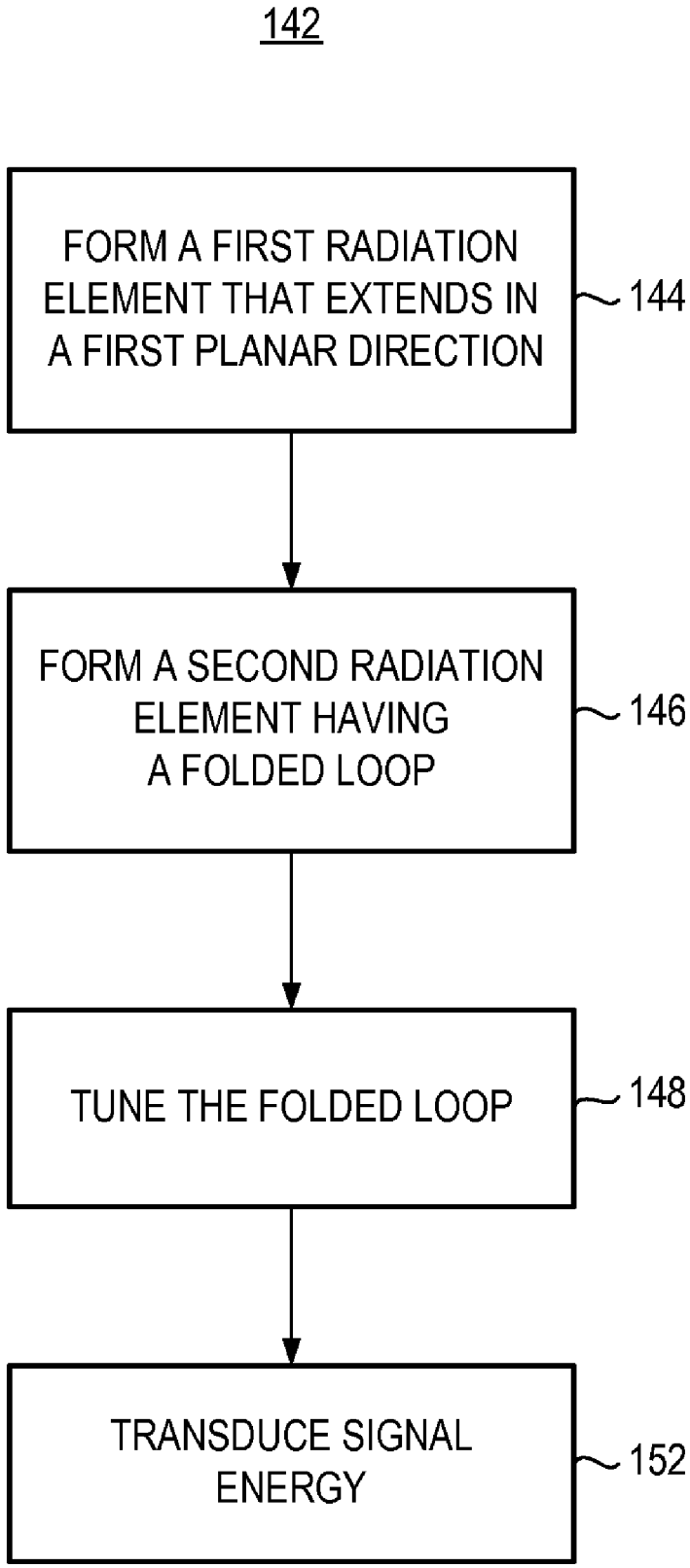
FIG. 7 illustrates a method flow diagram representative of method of operation of an embodiment of the present invention.

FIG. 7 illustrates a method flow diagram shown generally at 142, representative of the method of operation of an embodiment of the present invention. The method transuces signal energy at a radio device.

First, and as indicated by the block 144, a first radiation element is formed, comprised of a first patch defined to extend in a first planar direction and resonant at a first frequency band. Then, and as indicated by the block 146, a second radiation element is formed. The second radiation element includes a folded loop having a contiguous first portion. The contiguous first portion is contiguous and integral with the first patch. The second radiation element also includes a contiguous second portion, contiguous and integral with the first portion. The contiguous first portion is folded to be upstanding beyond the first patch in a second planar direction and the contiguous second portion is folded to extend in a third planar direction, offset from the second planar direction. The second radiation element is resonant at a second frequency band. The second radiation element further includes a contiguous third portion, contiguous and integral with the contiguous second portion. The contiguous third portion extends in a fourth planar direction, offset from the third planar direction. In one implementation, the element is formed such that the second and fourth planar directions are substantially parallel and such that the third planar direction is substantially parallel to the first planar direction in which the first element extends.

Then, and as indicated by the block 148, the folded loop is tuned. And, as indicated by the block 152, signal energy is transduced within any of the first and second frequency bands at any of the first patch and the folded loop.

Due to the tri-dimensional configuration of the antenna, a multi-band antenna is formed, of compact configuration, facilitating its use together with a mobile station, or other portable radio device.

Presently preferred embodiments of the invention and many of its improvements and advantages have been described with a degree of particularity. The description is of preferred examples of implementing the invention, and the description of preferred examples is not necessarily intended to limit the scope of the invention. The scope of the invention is defined by the following claims.

What is claimed is:

1. An antenna for a radio communication device, said antenna comprising:

a first patch forming a first radiation element, said first patch being substantially L-shaped and defined in a first planar direction, said first antenna patch being resonant at least at a first higher frequency band, said resonance determined by a dimension of the L-shaped patch and by a location of a connection of a second antenna patch to said first antenna patch; and said second patch forming a second radiation element and including a first portion, a second portion, and a third portion, said first portion being contiguous and integral with at least a portion of said first patch, the first portion being folded to extend in a second planar direction different than the first planar direction in which said first patch extends, said second portion being contiguous and integral with said first portion, said second portion being folded to extend in a third planar direction different than the second planar direction, said third portion being folded to extend in a fourth planar direction different than the third planar direction, the second patch being resonant at least at a lower frequency band and a second higher frequency band.

2. The antenna of claim 1 wherein said first patch forming the first radiation element comprises an elongated leg piece and a foot piece extending therefrom.

3. The antenna of claim 2 wherein the first higher frequency band at which said first patch is configured to be resonant is dependent upon a lengthwise dimension of the elongated leg piece.

4. The antenna of claim 3 wherein the lengthwise dimension of the elongated leg piece comprises an inner lengthwise dimension determined by positioning of the foot piece relative to the elongated leg piece.

5. The antenna of claim 3 wherein the lengthwise dimension of the elongated leg piece comprises an outer lengthwise dimension defining an entire length of the leg piece.

6. The antenna of claim 1 wherein the first higher frequency band at which said first patch is resonant is positioned between 1600 MHz and 2300 MHz.

7. The antenna of claim 1 wherein the first higher frequency band at least overlaps with the second higher frequency band.

8. The antenna of claim 1 wherein said first patch is further configured to include a communication-device feed point connection.

9. The antenna of claim 1 wherein said first patch is further configured to include a communication-device ground connection.

10. The antenna of claim 1 wherein the third planar direction in which the contiguous second portion extends is substantially perpendicular to the second planar direction in which the contiguous first portion extends.

11. The antenna of claim 1 wherein the fourth planar direction in which the contiguous third portion extends is substantially perpendicular to the third planar direction in which the contiguous second portion extends.

12. The antenna of claim 1 wherein the second higher frequency band at which the second radiation element is configured to be resonant is dependent upon a lengthwise dimension of said second patch.

13. The antenna of claim 1 wherein the second radiation element further comprises a tuning strip of a tuning-strip length, a lengthwise dimension of the tuning strip determinative, in part, of the lower frequency band at which said second patch is resonant.

14. The antenna of claim 1 wherein the first higher frequency band encompasses 1600-2300 MHz and wherein the second higher frequency band encompasses 1700-2200 MHz.

15. The antenna of claim 1 wherein the lower frequency band at which said second patch is resonant comprises a frequency band within a 824 MHz to 961 MHz range and wherein the second higher frequency band comprises a frequency band within a 1700 MHz to 2200 MHz range.

16. A method for transducing signal energy at a radio device, said method comprising the operations of:

forming a first radiation element comprised of a first patch being substantially L-shaped and defined to extend in a first planar direction and resonant at a first higher frequency band, said resonance determined by a dimension of the L-shaped patch and by a location of a connection of a second antenna patch to said first antenna patch;

forming said second radiation element comprised of a folded loop having a first portion, a second portion, and a third portion, including forming said first portion contiguous and integral with at least a portion of said first patch and folding said first portion to extend in a second planar direction different than the first planar direction in which said first patch extends, forming said second portion contiguous and integral with said first portion and folding said second portion to extend in a third planar direction different than said second planar direction, and folding said third portion to extend in a fourth planar direction different than said third planar direction, the second radiation element resonant at least at a lower frequency band and a second higher frequency band; and transducing signal energy within any of the first and second higher and the lower frequency bands at any of the first patch and the folded loop.

17. The method of claim 16 comprising the further operation of tuning the folded loop.

18. An antenna for pent-band radio communication for connection to a radio transceiver circuitry, said antenna being mounted on a substrate and comprising:

a first patch forming a first radiation element said first patch being L-shaped and having a lengthwise-extending leg part and an outwardly-extending foot part, a lengthwise dimension of said first patch extending in a linear direction along an entire length of said first patch, an inner lengthwise dimension also extending in the linear direction to the outwardly-extending foot part, said first patch including a feed point connection extending from and contiguous with said first patch, said first patch being connected to the radio transceiver circuitry at said feed point connection and at a ground connection for the antenna, said first patch being configured to resonate at a frequency determined by the lengthwise dimension of said patch and by a location of a connection of a second folded patch to said first patch, said first patch being resonant at least at a first higher frequency band; and said second folded antenna patch forming a second radiation element, and including a first portion, a second portion and a third portion, said first portion being contiguous and integral with at least a portion of said first patch, said first portion of said second folded antenna patch being folded to extend in a second planar direction substantially perpendicular to a first planar direction of said first patch, said second portion of said second folded patch being contiguous and integral with said first portion and being folded to extend in a third planar direction, said second portion having a tuning strip of a length determinative of one of the frequency ranges of the antenna, said third portion of said second folded antenna patch being folded to extend in a fourth planar direction substantially perpendicular to said third planar direction of said second portion, said second patch resonant at least at a lower frequency band and a second higher frequency band.

19. The antenna of claim 18, wherein the first higher frequency band at which said first patch is configured to be resonant is dependent upon a lengthwise dimension of the lengthwise-extending leg part of said first patch.

20. The antenna of claim 19 wherein the lengthwise dimension of said first patch comprises an inner lengthwise dimension determined by positioning of said foot piece relative to said elongated leg piece.

21. The antenna of claim 19 wherein said lengthwise dimension of said elongated leg piece comprises an outer lengthwise dimension defining an entire length of the leg piece.

22. The antenna of claim 18 wherein said first higher frequency band at which said first patch is resonant is positioned between 1600 MHz and 2300 MHz.

23. The antenna of claim 18 wherein said first higher frequency band at least overlaps with said second higher frequency band.

24. The antenna of claim 18 wherein said first patch is further configured to include a communication-device feed point connection.

25. The antenna of claim 18 wherein said first patch is further configured to include a communication-device ground connection.

26. The antenna of claim 18 wherein said third planar direction in which said second portion extends is substantially perpendicular to said second planar direction in which said first portion extends.

27. The antenna of claim 18 wherein said second higher frequency band at which said second patch is configured to be resonant is dependent upon a lengthwise dimension of said second patch.

28. The antenna of claim 18 wherein said second radiation element forming said second patch further comprises a tuning strip of a tuning-strip length, a lengthwise dimension of the tuning strip determinative, in part, of the lower frequency band at which said second patch is resonant.

29. The antenna of claim 18 wherein said first higher frequency band encompasses 1600-2300 MHz and wherein said second higher frequency band encompasses 1700-2200 MHz.

30. The antenna of claim 18 wherein said lower frequency band at which said second patch is resonant comprises a frequency band within a 824 MHz to 961 MHz range and wherein said second higher frequency band comprises a frequency band within a 1700 MHz to 2200 MHz range.

31. A method for transducing signal energy at a pent-band radio device, said method comprising the operations of:

forming a first radiation element comprised of an L-shaped patch defined to extend in a first planar direction and resonant at a first higher frequency band, said L-shaped patch having a lengthwise-extending leg part and an outwardly-extending foot part, a lengthwise dimension of the L-shaped patch extending in a linear direction along an entire length of the L-shaped patch and an inner lengthwise dimension also extending in the linear direction to the outwardly-extending foot part, the first L-shaped patch including a feed point connection extending from and contiguous with the L-shaped patch, the L-shaped patch for connection to radio transceiver circuitry at the feed point connection and at a ground connection for said first radiation element, the L-shaped patch being resonant at a frequency determined by the lengthwise dimension of said L-shaped patch and by a location of a connection of a second radiation element to said L-shaped patch;

forming said second radiation element comprised of a folded patch being contiguous and integral with at least a portion of said first radiation element and having a first portion, a second portion, and a third portion, said first portion of said folded patch being folded to extend in a second planar direction substantially perpendicular to a first planar direction of said L-shaped patch, said second portion of said folded patch being contiguous and integral with said first portion and being folded to extend in a third planar direction, said second portion having a tuning strip of a length determinative of one of the frequency ranges of at least one of said first and second radiation elements, said third portion of said folded patch being folded to extend in a fourth planar direction substantially perpendicular to said third planar direction of said second portion, said second radiation element resonant at least at a lower frequency band and a second higher frequency band;

mounting said first and second radiation elements on a substrate and connecting said first radiation element to circuitry of said pent-band radio device; and transducing signal energy within any of the higher and lower frequency bands at any of said first radiation element and said second radiation element.

32. The method of claim 31 comprising the further operation of tuning the tuning strip.

* * * * *